US006918867B2

(12) United States Patent
Scherbarth et al.

(10) Patent No.: US 6,918,867 B2
(45) Date of Patent: Jul. 19, 2005

(54) PRODUCTION OF FILTER ELEMENTS NOT SUITABLE FOR CUTTING

(75) Inventors: Thorsten Scherbarth, Geesthacht (DE); Sönke Horn, Geesthacht (DE); Andreas Rinke, Bad Oldesloe (DE); Matthias Jahnke, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/658,689

(22) Filed: Sep. 10, 2003

(65) Prior Publication Data

US 2004/0087424 A1 May 6, 2004

(30) Foreign Application Priority Data

Sep. 11, 2002 (EP) ..... 02020290
Jun. 30, 2003 (EP) ..... 03014817

(51) Int. Cl.[7] ..... B31C 13/00
(52) U.S. Cl. ..... 493/39; 493/42; 493/46
(58) Field of Search ..... 493/39, 42, 46, 493/47, 48, 50

(56) References Cited

U.S. PATENT DOCUMENTS 3,822,710 A 7/1974 Bramhill
4,064,791 A * 12/1977 Berger ..... 493/43
4,331,166 A * 5/1982 Hale ..... 131/331
4,525,161 A * 6/1985 Luke ..... 493/42
4,583,560 A * 4/1986 Sakai et al. ..... 131/336
5,088,507 A 2/1992 Baker et al.
5,115,823 A * 5/1992 Keritsis ..... 131/336
5,348,027 A * 9/1994 Barnes et al. ..... 131/194
5,692,525 A * 12/1997 Counts et al. ..... 131/194
6,202,650 B1 * 3/2001 Kaneki et al. ..... 131/360
6,209,547 B1 * 4/2001 Koller et al. ..... 131/331
6,336,896 B1 * 1/2002 Hsu et al. ..... 493/39
6,595,218 B1 * 7/2003 Koller et al. ..... 131/331

FOREIGN PATENT DOCUMENTS

EP 1 226 765 7/2002
FR 1 330 957 6/1963

* cited by examiner

*Primary Examiner*—Sameh H. Tawfik
(74) *Attorney, Agent, or Firm*—Venable LLP; Catherine M. Voorhees

(57) ABSTRACT

A method and apparatus for producing multi-segment filter elements in the tobacco-processing industry. The multi-segment filter elements each include a first filter segment and at least one second filter segment. A sleeve element is arranged in the first filter segment. The second filter segment is inserted into the sleeve element in the first filter segment and the sleeve element is pulled out.

17 Claims, 8 Drawing Sheets

PRODUCTION OF FILTER ELEMENTS NOT SUITABLE FOR CUTTING

CROSS-REFERENCE TO RELATED APPLICATION

This application claims the priority of European Application No. 02 020 290.9, filed on Sep. 11, 2002 and European Application No. 03 014 817.5, filed on Jun. 30, 2003, the disclosures of which, together with the disclosures of each and every U.S. and foreign patent and patent application mentioned herein, are incorporated herein by reference.

BACKGROUND OF THE INVENTION

The invention relates to a method for producing filter elements in the tobacco-processing industry, in particular multi-segment filters consisting of a first filter segment and at least one second filter segment. The invention furthermore relates to a filter, in particular a multi-segment filter, as well as an apparatus for producing filter elements in the tobacco-processing industry and in particular for producing multi-segment filters having a first filter segment and at least one second filter segment. The invention also relates to a machine for producing filters in the tobacco-processing industry, in particular multi-segment filters.

U.S. Pat. No. 5,088,507 discloses an apparatus for joining an aerosol-generating cartridge and a completed filter cigarette, wherein the cartridge is inserted into the cigarette and a support tube is ejected following the completion.

However, this apparatus is not suitable for producing filter segments for a multi-segment filter since only the final products are joined in the disclosed apparatus. Among other things, multi-segment filters consist of fragile, impact-sensitive filter sections, wherein the filter sections are not surrounded by an enveloping paper strip, but are combined to form a group of filter segments which are subsequently shaped into a filter rope with the aid of a rope-forming technique.

For the production of cigarette filters, in particular multi-segment filters, the filter rods are produced from different types of basic filter rods, in accordance with the desired filter characteristics. The basic filter rods are cut for this, are grouped together, enveloped inside a filter-rod producing machine and are then cut into multiple-length filter rods.

Among other things, hard filter elements are also used for producing multi-segment filters. Since hard filter elements consist either of an impact-sensitive and breakable material or of a non-elastic and non-compressible hard material, it is important that the sensitive hard elements be handled and conveyed with extreme care during the filter production.

SUMMARY OF THE INVENTION

Thus, it is the object of the present invention to provide a filter element for a multi-component filter, wherein it should be possible to provide sensitive filter elements and/or filter elements that cannot be cut, in particular hard filter elements, in a simple and secure manner with a soft, compressible wrapper.

The above and other objects are achieved according to one aspect of the invention the invention by the provision of a method for producing multi-segment filter elements in the tobacco-processing industry, wherein the multi-segment filter elements each include a first filter segment and at least one second filter segment, the methods comprising: arranging a sleeve element in the first filter segment; inserting the second filter segment into the sleeve element in the first filter segment; and pulling the sleeve element out.

The sleeve element creates a cavity and channel in the first filter segment, through which the second filter segment is inserted. The first filter segment can consist of cellulose acetate, for example, so that after inserting a hard segment (second filter segment), the hard segment is surrounded by a compressible sleeve. By forming a defined cavity and channel in the first filter segment, a different and second filter segments, including hard segments can be inserted and enveloped, independent of their condition or surface. The production of the filter element, consisting of the first filter segment and the second filter segment, is not limited to the use of specific materials. The sleeve element makes it possible to even insert second filter segments that have a rough surface. Furthermore, there are no restrictions with respect to the first filter segment material that forms enveloping material. For example, the first filter segment can consist of a short-fiber material, wherein the fibers are not glued together. Within the framework of this invention, it is also conceivable that the first filter segment is designed to be hollow on the inside, meaning it is ring-shaped and/or forms a hollow ring. The use of this sleeve element makes it easy to exactly position the second filter segment to ensure a good centering of the filter element. Furthermore ensured is the clean processing independent of the material properties of one or both filter segments, so that higher production capacities of up to 20,000 filter segments per minute can be reached.

In one exemplary embodiment, the material of the first filter segment is compacted prior to arranging the sleeve element, so that the sleeve element subsequently forms a cavity in the first filter segment.

The material of the first filter segment is preferably compacted with the aid of a mandrel element. The mandrel element may be admitted with ultrasound to reduce the frictional resistance between the material of the first filter segment and the mandrel element while the mandrel penetrates the first filter element, thus making it easier for the mandrel element to pierce the filter segment.

If the mandrel element has a low-friction surface, preferably a ceramic coating or an electroplated chromium coating, the mandrel element can be inserted without problems into the first filter segment.

According to another exemplary embodiment, the mandrel element may pierce the first filter segment with a rotating motion and come into contact with the sleeve element.

Once the mandrel element has pierced the first filter segment, a cavity is formed with particular reliability in the first filter segment if the sleeve element is inserted into the filter segment while still in contact with the mandrel element. For this, the mandrel element is pulled back and the sleeve element is inserted flush with the mandrel element into the filter segment.

The second filter segment is inserted securely into the first filter segment if the second filter segment is advantageously arranged inside the sleeve element. Once the second filter segment is arranged, the filter segment is displaced and is positioned precisely in the cavity formed inside the first filter segment.

The handling of the first filter segment may be improved by securing it in place, particularly prior to compacting the material of the first filter segment.

After the sleeve element is pulled back out, the filter element may be released again to allow further processing of the produced filter element and to make it available, for example for use in a multi-segment filter.

Following the removal of the sleeve element, the filter element may be transferred to a conveying means, in particular a conveying drum.

The process steps may be advantageously realized on a conveying drum, in particular a filter module on a machine for producing filter rods, preferably multi-segment filters.

According to another aspect of the invention, there is provided a filter, in particular a multi-segment filter provided with a filter element, made according to the above-described process steps.

According to yet another aspect of the invention, there provided an apparatus for producing multi-segment filter element in the tobacco-processing industry, the multi-segment filter element including a first filter segment and a second filter segment, comprising: a sleeve element; means for forming a cavity in the first filter element with the use of the sleeve element; and means for inserting the second filter segment into the cavity of the first filter segment.

The apparatus according to the invention makes it possible to provide hard segments that cannot be cut with a soft wrapper having a compressible outer envelope.

According to one exemplary embodiment, a mandrel element is provided for compacting the material in the first filter segment.

The sleeve element may be provided with a receptacle for the second filter segment, so that any optional second filter segment can be used safely as an inside part of the filter element, thus resulting in high variability in the production of filter elements according to the invention.

The sleeve element and the mandrel element are desirably brought in contact to form a hollow body, or cavity, in the first filter segment.

The mandrel element can be inserted easily into the first filter element if the mandrel element can be admitted with ultrasound, which reduces the frictional resistance. A further reduction in the frictional resistance may be achieved if the shape of the mandrel element is predetermined, for example by fitting on an additional tip, so that the mandrel element can penetrate easier.

The mandrel element preferably may be provided with a low-friction surface, in particular a ceramic coating or an electroplated chromium coating.

An element for securing the first filter segment in place may be provided, in particular to keep the first filter segment from moving because of the enveloping, thus achieving a compacting of the material.

It is furthermore advantageous if the apparatus is designed as conveying means, in particular as conveying drum, preferably part of a module for producing filter elements.

According to yet a further aspect of the invention there is provided a machine for producing filters, particularly multi-segment filters in the tobacco-processing industry, which machine comprises an inventive apparatus as described in the above.

BRIEF DESCRIPTION OF THE DRAWINGS

In the following, the invention is described with examples, without restricting the general idea of the invention, by using exemplary embodiments and by referring to the drawings, to which reference is expressly made with respect to all details of the disclosure that are not explained further in the text.

DETAILED DESCRIPTION OF THE INVENTION

In the following Figures, the same elements are provided with the same reference numbers and will not be introduced again.

Figure 1:
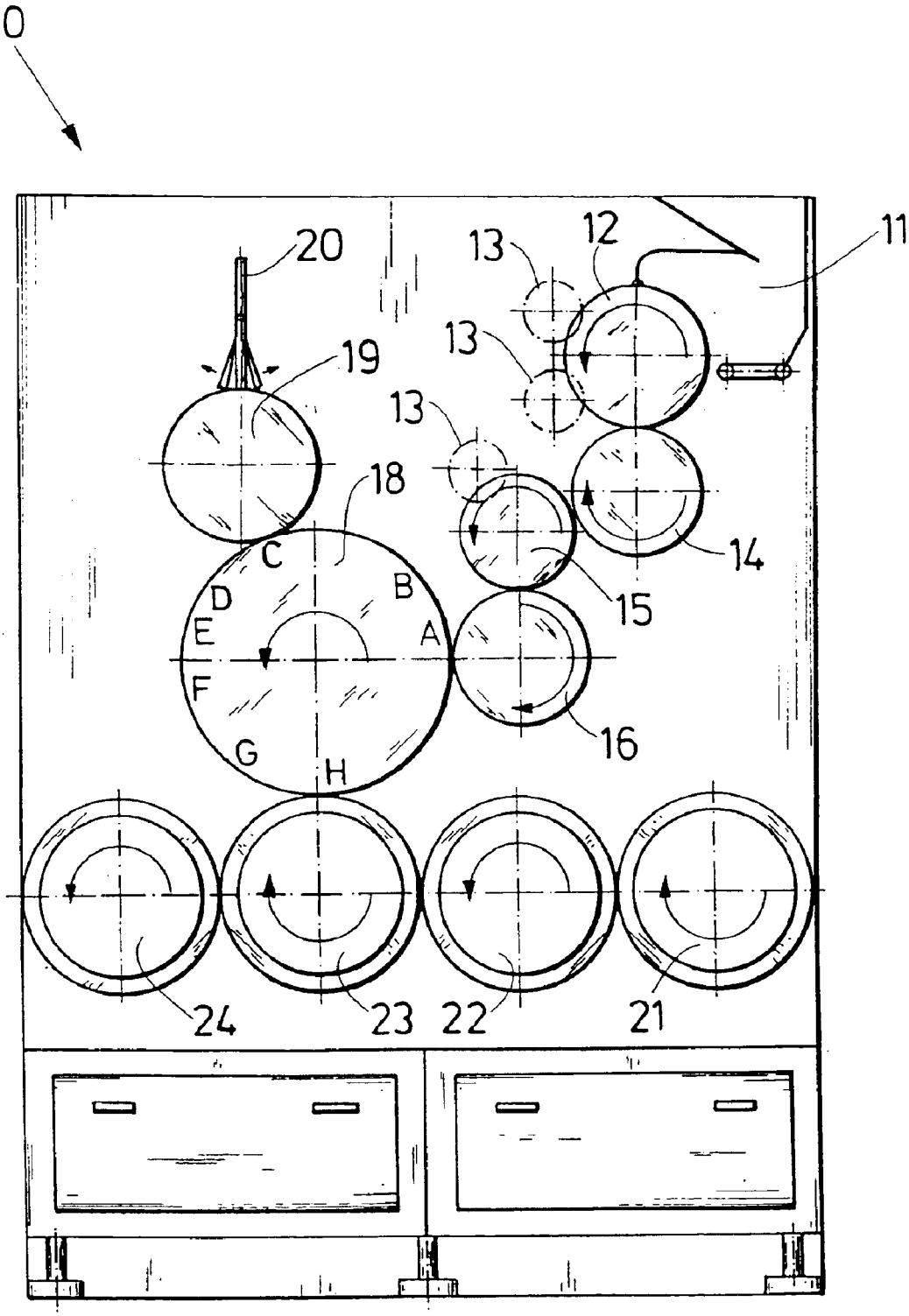
FIG. 1 shows a frontal view of a module for a multi-segment filter machine.

Referring to FIG. 1, there is shown a schematic view from the front of a module 10 on a multi-segment filter machine. This module 10 is suitable for producing filter elements and/or segments that cannot be cut, which are then further processed in the multi-segment filter machine, together with additional filter segments from other modules, and formed into multi-segment filters. Within the framework of this invention, a filter element that cannot be cut in particular refers to a filter element having a compressible outer envelope and an optional filter segment disposed on the inside.

In the module 10, filter rods, preferably consisting of a particularly light-weight material such as cellulose acetate, are removed from a filter magazine 11 with the aid of a filter-removal drum 12 and are then cut with knives 13 into multiple filter segments and/or filter sections. The cut filter segments are then staggered on a staggering drum 14 and transferred to a cutting/pushing drum 15 where the cut filter segments are cut again and pulled apart. Following this, respectively two parallel-conveyed filter segments are transferred to the insertion drum/wobble drum 16 which then transfers the cut filter segments to an operating drum 18. For one preferred embodiment, two filter elements 8 (see FIG. 2*g*) are produced on the operating drum 18, positioned mirror-reversed and parallel.

In addition, impact-sensitive hard filter segments are supplied via a feed-in 20, the lower end of which is positioned such that it can pivot, and a trough drum 19 to the operating drum 18. The feed-in 20 and the trough drum 19 are described in German Patent Application 101 46 992.6 co-owned by the Assignee of the present application and are particularly suitable for treating and further conveying impact-sensitive filter segments and/or sections. The disclosure of the foregoing German patent application is incorporated herein by reference.

According to the invention, the filter elements, consisting of the cut filter segments (first filter segment) and the hard filter segments (second filter segment) supplied via the trough drum 19 are produced on the operating drum 18. The inventive filter elements are produced with the process steps A to H represented on operating drum 18 in FIG. 1 and described in more detail below with reference to the cross sectional schematic views shown in FIGS. 2*a* to 2*h*.

The completed filter element is then transferred to a conveying drum 23. Additional filter segments from other modules of the multi-segment filter machine are transferred with the conveying drums 21, 22 to the conveying drum 23. The filter elements and/or filter segments are subsequently transferred to a drum 24 and then removed.

Figure 2A:
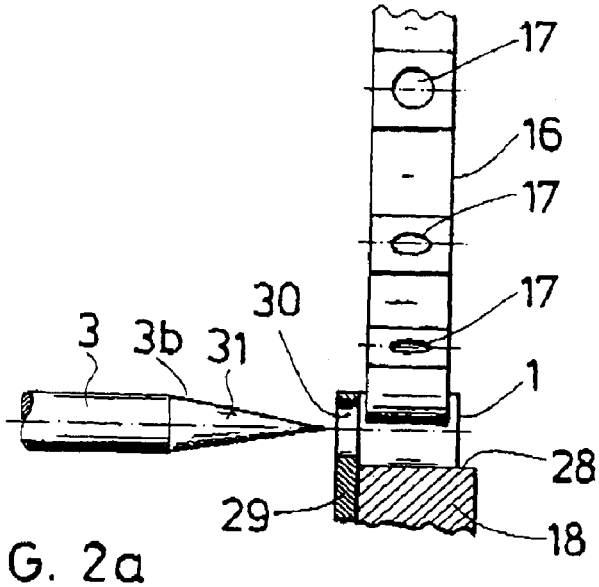
FIGS. 2*a* to 2*h* illustrate in cross section a schematic view of the process steps for producing a multi-segment filter element according to the invention.

FIG. 2*a* shows the transfer of a first filter segment 1, for example consisting of cellulose acetate, from the insertion drum/wobble drum 16 to the operating drum 18. The insertion drum/wobble drum 16 is provided with suction bores 17 in the holding troughs, which are designed to hold the filter segments 1 on the insertion drum/wobble drum 16. During the transfer of the filter segments 1, the vacuum supplied to the corresponding suction bore 17 is turned off, so that the filter segment 1 is transferred to a holding trough 28 of the operating drum 18.

The operating drum 18 is additionally provided on the side with an end stop 29 that has a bore 30 in the area where the filter segment 1 is deposited. A rotating mandrel 3 with a tip 31 is arranged at the side of the holding trough 28 and/or the filter segment 1. The diameter of this mandrel 3 essentially corresponds to the diameter of the bore 30 in the end stop 29.

Figure 2B:
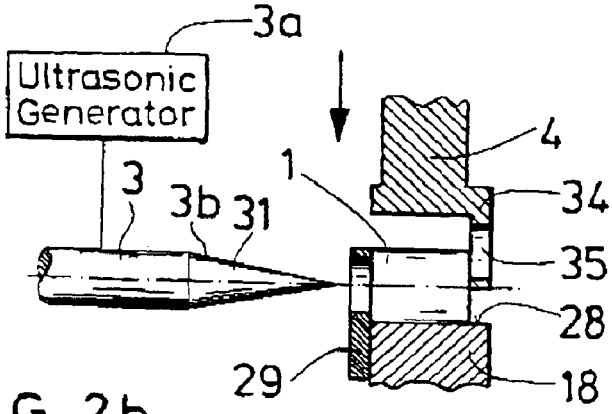
Figure 2C:
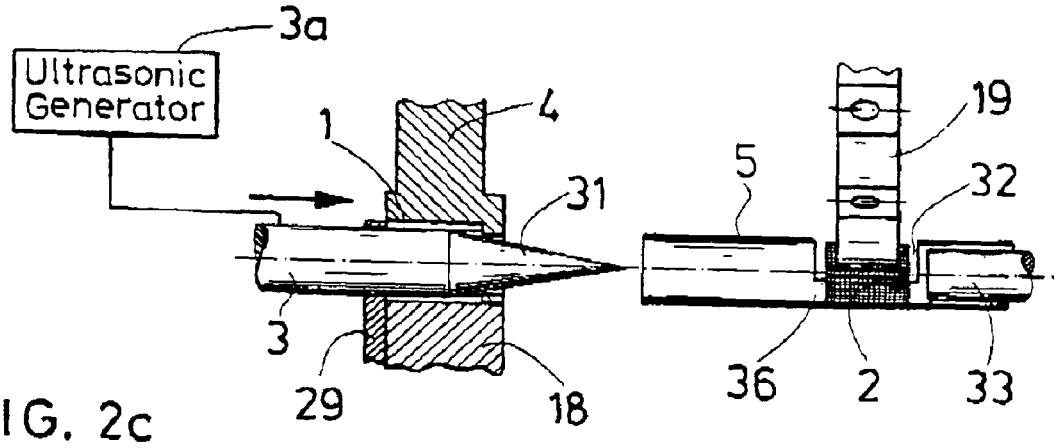
Figure 2D:
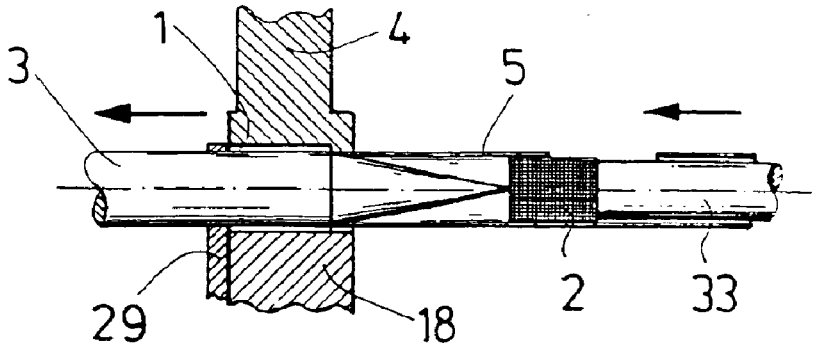

Following insertion, a fixing arm 4 securely encloses the filter segment 1 inside the holding trough 28. The fixing arm 4 is preferably designed such that it can pivot on the operating drum 18. The fixing arm 4 furthermore is provided on its side with a stop 34 which contains a bore 35. The diameter of this bore 35 corresponds to the diameter of the bore 30 in the end stop 29 and/or the diameter of the mandrel 3 (FIG. 2*b*).

Once the first filter segment 1 is secured, the rotating mandrel 3 completely pierces the filter segment 1 in a relative movement between filter segment 1 and mandrel 3, so that the filter material is compacted. The mandrel 3 may be coupled to an ultrasonic generator 3*a* (shown only in FIGS. 2*b* and 2*c* for ease of illustration) so that mandrel 3 may be admitted with ultrasound to make it easier for the mandrel 3 to pierce the filter material of the first filter segment 1. The mandrel 3 furthermore can have a wear-resistant surface 3*b* (FIGS. 2*a*, 2*b*) having a low frictional coefficient. For example, the mandrel 3 may be coated with either ceramic coating or an electroplated chromium coating. In addition, the mandrel tip 31 can be provided with an additional tip to improve the piercing by the mandrel 3.

For an alternative embodiment not shown here, the first filter segment 1 may be embodied as a hollow ring, in which case the mandrel 3 expands the ring-shaped filter segment 1 and/or spreads it out. As a result, sufficient space is created inside the ring-shaped first filter segment 1, so that the second filter segment 2 can be securely inserted and enveloped by the first filter segment 1.

While the mandrel 3 pierces the first filter segment 1, a second filter segment 2 is simultaneously deposited by the trough drum 19 (FIG. 2*c*) in a sleeve 5, that is to say inside an opening 32 of sleeve 5, which is arranged next to the mandrel 3. The opening 32 forms a receptacle 36 for the second filter segment 2 in the sleeve 5. The distance between the front of the sleeve 5 and this receptacle is at least as long as the length of tip 31 for the mandrel 3. In addition, a pusher 33 is arranged inside the sleeve 5, on the side facing away from the mandrel 3, for displacing the second filter segment 2 inside the sleeve 5.

The mandrel 3 is used to expand the first filter segment 1 from the center outward. Following the complete piercing of the filter segment 1, the sleeve 5 and the mandrel 3 are joined so that they are flush (FIG. 2*d*), meaning so that the sleeve 5 directly adjoins the mandrel 3. Following this, the mandrel 3 and the sleeve 5 are jointly moved back, so that the sleeve 5 is inserted into the first filter segment 1 and forms a cavity with a solid wall in the first filter segment 1. During or after the mandrel 3 is pulled back, the pusher 33 displaces the second filter segment 2 arranged inside the sleeve 5 in the direction of the first filter segment 1.

Figure 2E:
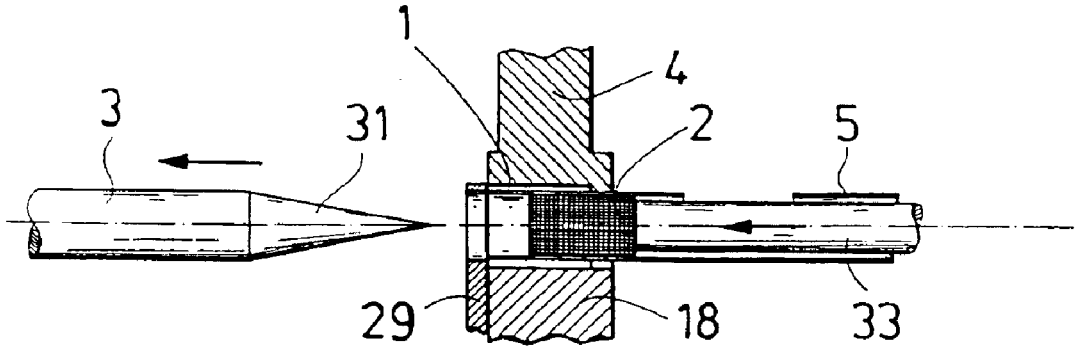
Figure 2F:
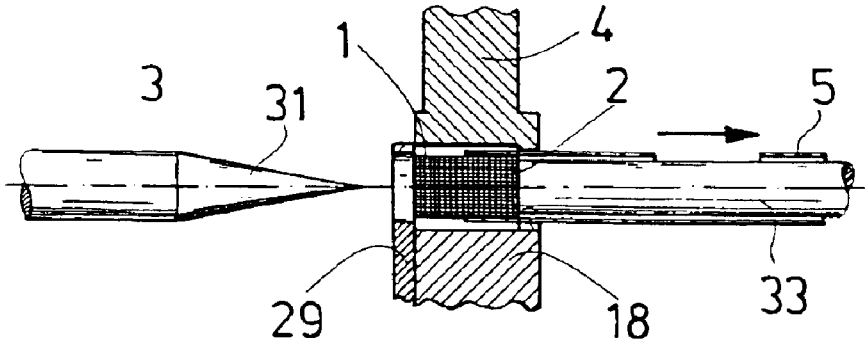
Figure 2G:
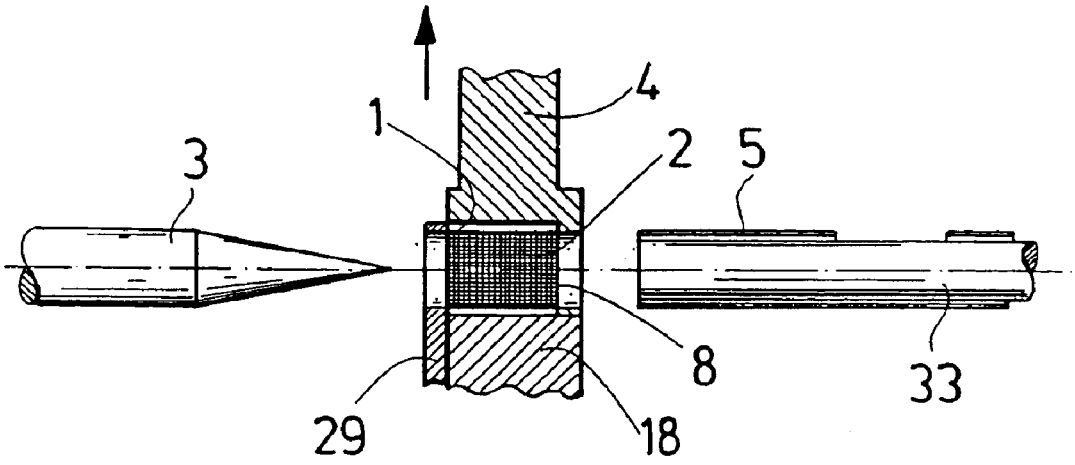

FIG. 2*e* shows the maximum position for sleeves 5 where the mandrel 3 is pulled out of the first filter segment 1 and the second filter segment 2 is pushed in with the aid of pusher 33.

Figure 2H:
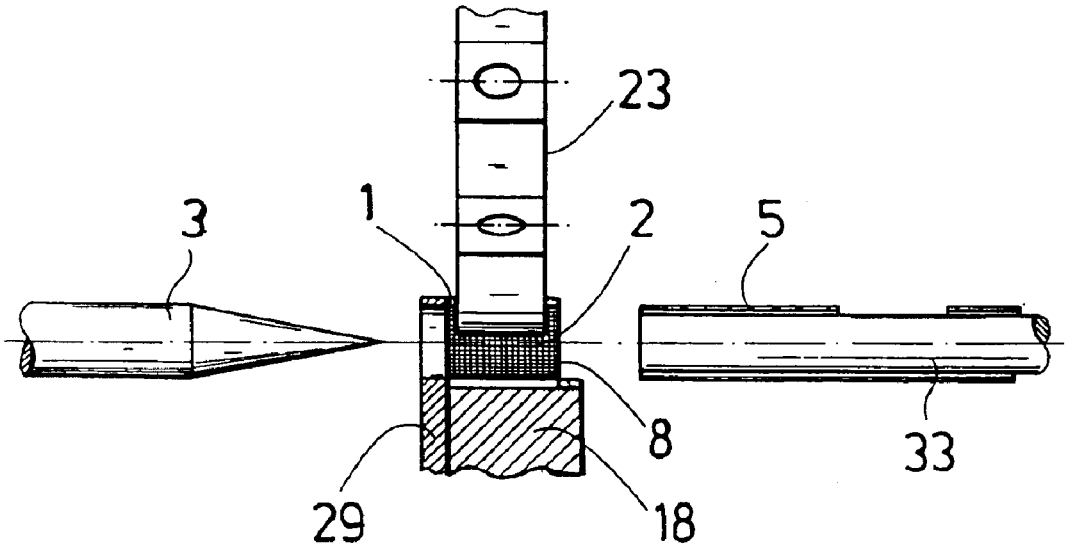

Once the second filter segment 2 (FIG. 2*f*) reaches the end position, the sleeve 5 is pulled out, wherein the pusher 33 functions as a counter-holder for the second filter segment 2. Once the sleeve 5 is pulled out completely, the filter element 8 that consists of the first filter segment 1 and the second filter segment 2 (FIG. 2*g*) is released from the secured position. The completed filter element 8 is then transferred to the conveying drum 23 (FIG. 2*h*).

Figure 3:
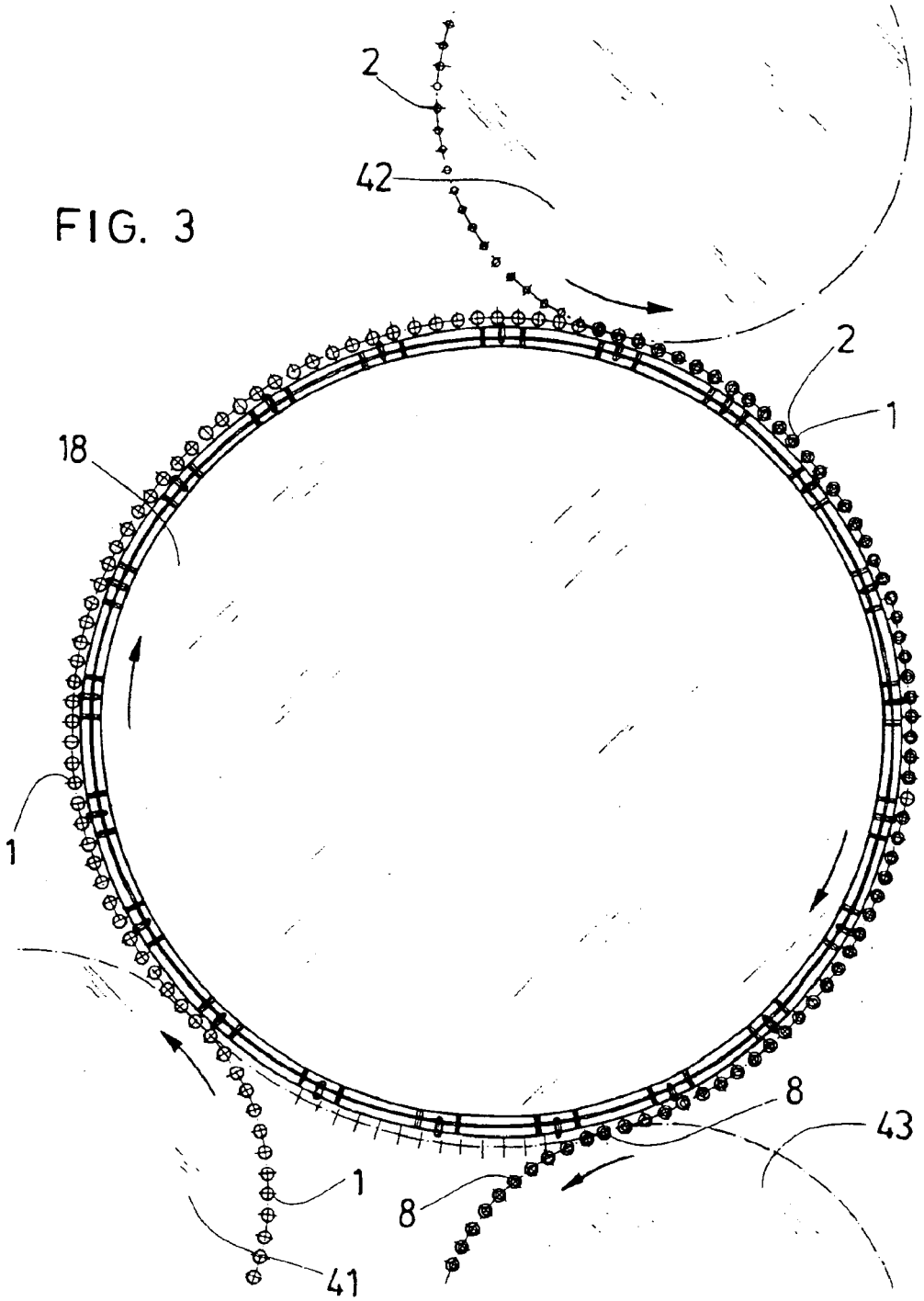
FIG. 3 illustrates a schematic view of a drum arrangement with an operating drum for realizing the method according to the invention.

FIG. 3 shows a drum arrangement with an additional exemplary embodiment of an operating drum 18 for producing a filter element according to the invention. For this, first filter segments 1 are transferred from a conveying drum 41 to the operating drum 18. Along the conveying path from the point where filter segments 1 are transferred from the conveying drum 41 to the operating drum 18, up to an insertion drum 42 for the second filter segments 2, the filter segments 1 are compacted annularly on the operating drum 18. After the insertion drum 42 has supplied the second filter segments 2, the first and second filter segments 1 and 2 are joined to form a single filter element 8. Following the production of filter elements 8, the completed filter elements 8 are picked up by a removal drum 43 and transported away from the operating drum 18.

FIGS. 4*a* to 4*i* show schematic cross-sectional views of the individual process steps for producing a filter element 8 on the operating drum 18, as shown in FIG. 3. The process sequences according to FIGS. 4*a* to 4*i* are described in the following. The production of a filter element 8 consisting of a first filter segment 1 and a second filter segment 2 is realized on dual tracks on the operating drum 18. That is to say, two rows of first filter segments 1 on the conveying drum 41 are transferred from the conveying drum 41 to the operating drum 18 (compare FIG. 3). As a result, filter elements 8 are produced in two rows parallel and symmetrical as well as simultaneously along the conveying path for the filter segments 1 and 2. For reasons of clarity, FIGS. 4*a* to 4*i* show only the production of a filter element 8 for the left side of the operating drum 18. However, since the process steps are realized symmetrical to an axis of symmetry 55 for the operating drum 18, the following also applies to the right portion of the operating drum 18.

Figure 4A:
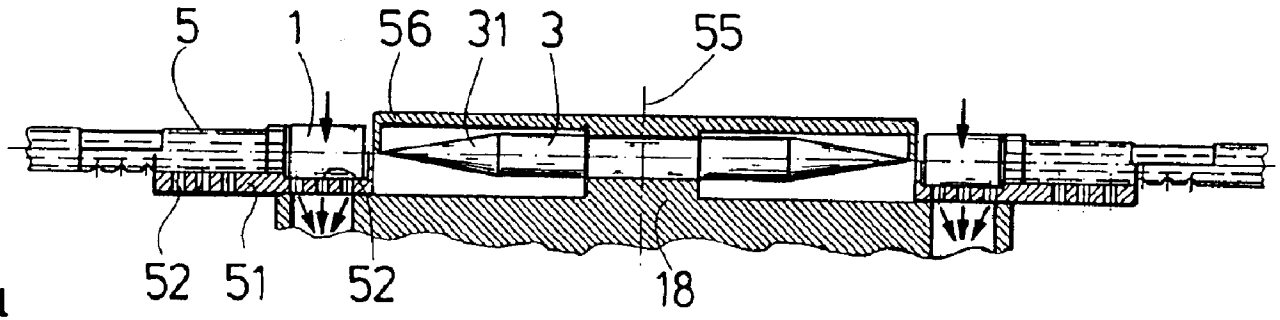
FIGS. 4*a* to 4*i* illustrate in a cross section individual process steps on the operating drum according to FIG. 3.

Based on the situation shown in FIG. 4*a*, a first filter segment 1 is transferred from the conveying drum 41 (compare FIG. 3) to the operating drum 18. For this, the first filter segment 1 is inserted into a holding trough of a horizontally displaceable sled 51. The sled 51 contains suction bores 52 for holding the filter segment 1 on the sled 51 (as a result of a vacuum pressure being applied to the operating drum 18) which can be displaced in a longitudinal axial direction.

The operating drum 18 furthermore is provided with a mandrel 3 having a tip 31, which is arranged locally fixed on the operating drum 18. Toward the top, the mandrel 3 is delimited by a cover 56 so that the mandrel 3 is otherwise open on the side facing the filter segment 1. In particular, the mandrel 3 is surrounded on all other sides by walls and is therefore spatially delimited.

The sleeve 5 is arranged on the side facing away from the mandrel 3 and located opposite the first filter element 1. The push rod 33 is located inside the sleeve 5. The sled 51, the sleeve 5 and the pusher 33 can be moved independent of each other in the longitudinal axial direction.

Figure 4B:
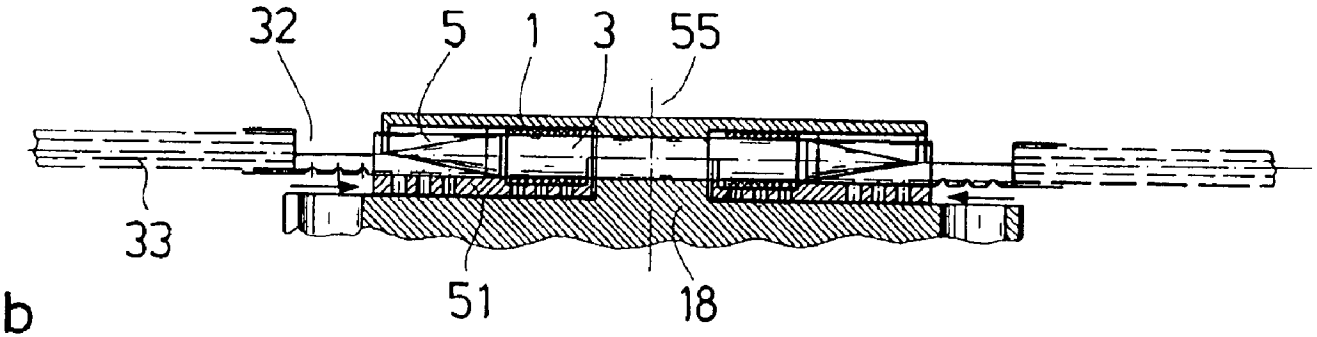

Once the first filter segment 1 has been transferred to the receptacle in the sled 51 (FIG. 4*a*), the sled 51 is displaced in the direction of the mandrel 3, so that it can pierce and compact the first filter segment 1, which is shown in FIG. 4*b*. At the same time or following the displacement of sled 51, the sleeve 5 is moved in the same direction, so that the sleeve 5 comes to rest on the conical surface of the mandrel tip 31 (compare FIG. 4*b*).

Figure 4C:
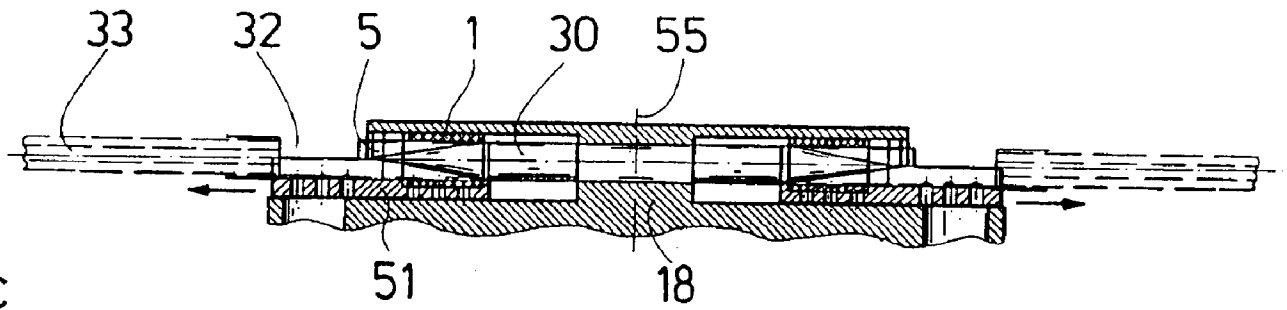
Figure 4D:
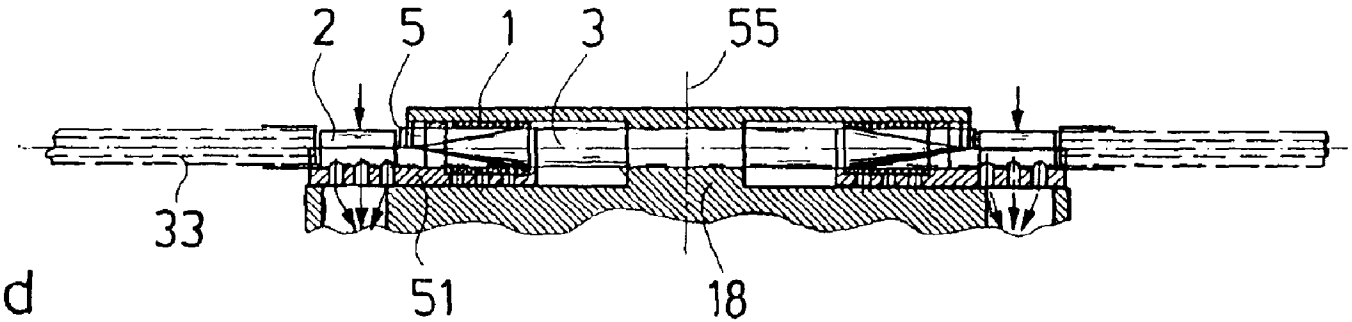
Figure 4E:
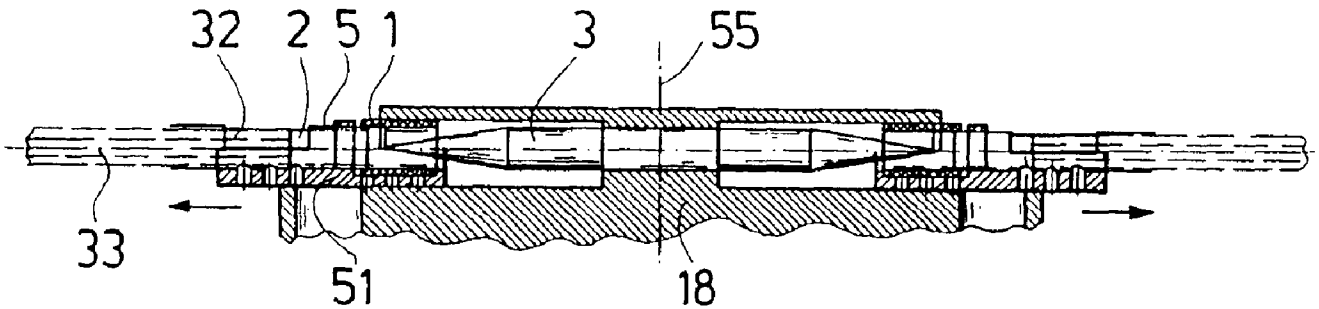
Figure 4F:
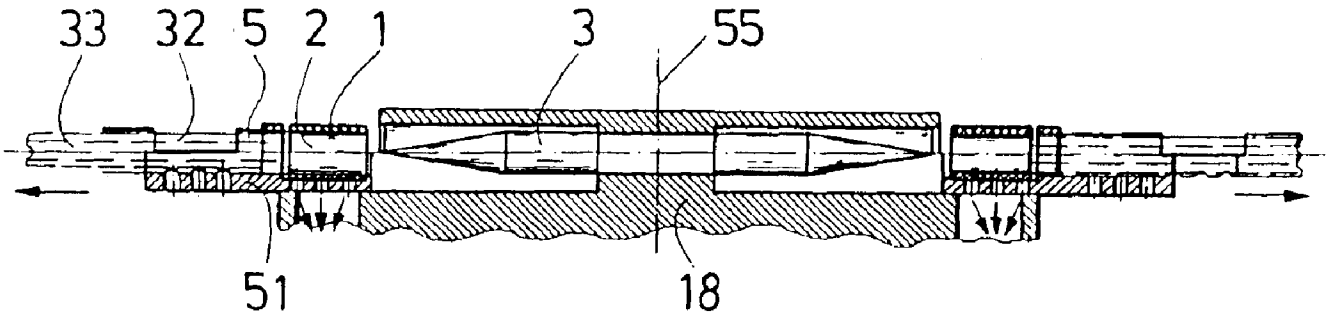

The compacted filter segment 1 is then moved back together with the sled 51, so that the ring-shaped, compacted filter segment 1 is fitted over the sleeve 5 (compare FIG. 4*c*). For this, only the sled 51 is moved back in longitudinal axial direction while the sleeve 5 and the pusher 33 remain unchanged in their positions. FIG. 4*d* shows the operating drum 18 during the operational stage where the insertion drum 42 (FIG. 3) inserts the second filter segment 2 into the opening 32 of the sleeve 5 (FIG. 4*c*). For this, the sleeve 5 is provided on the bottom with recesses, toward the operating drum 18, so that the inserted second filter segments 2 are held inside the sleeve 5 and on the operating drum 18 by supplying vacuum air to the operating drum 18.

Following this, the sleeve 5 together with the compacted first filter segment 1 is moved toward the outside (FIG. 4*e*), wherein the second filter segment 2 is held in the same location with the pusher 33. The sled 51 and the sleeve 5 together with the first filter segment 1 are displaced simultaneously until the first filter segment 1 surrounds the second filter segment 2.

In another process step, the sleeve 5 is completely pulled out in the longitudinal axial direction, so that the filter element 8 is created as a result of the first filter segment 1 enveloping the second filter segment 2. The filter segment 8 is held on the sled 51 (FIG. 4*f*) by supplying a vacuum to the inside of operating drum 18.

Figure 4G:
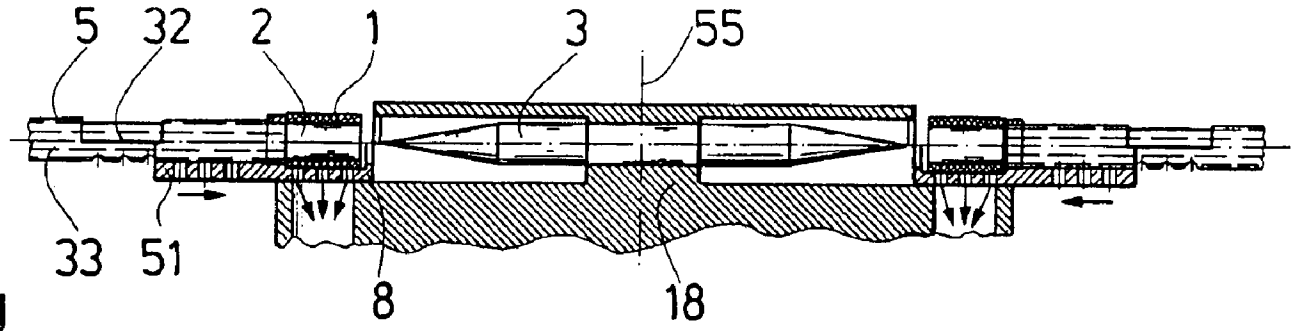
Figure 4H:
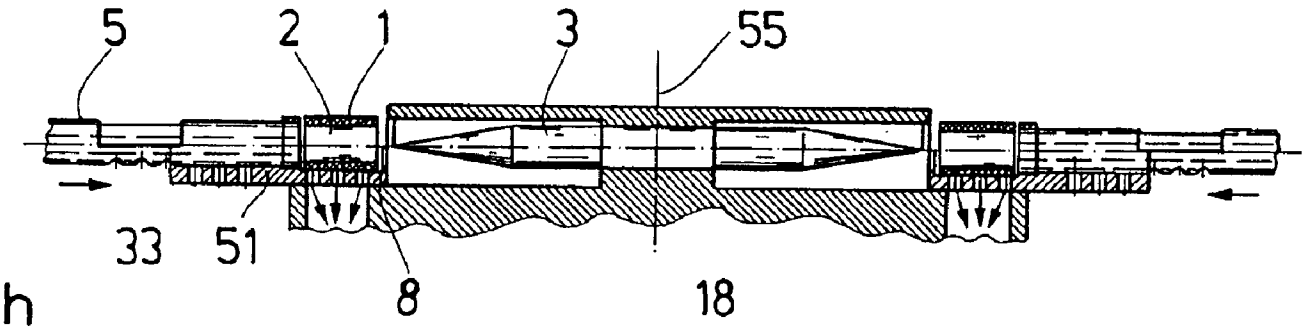

FIG. 4*g* shows the situation where the sleeve 5 is pulled out completely between the first and the second filter segments 1 and 2. Vacuum pressure is used to hold the filter element 8 inside the holding trough of sled 51. The completed filter element 8 is subsequently moved to a removal position (compare FIG. 4*h*) by displacing the sleeve element 5 in a longitudinal axial direction.

Figure 4I:
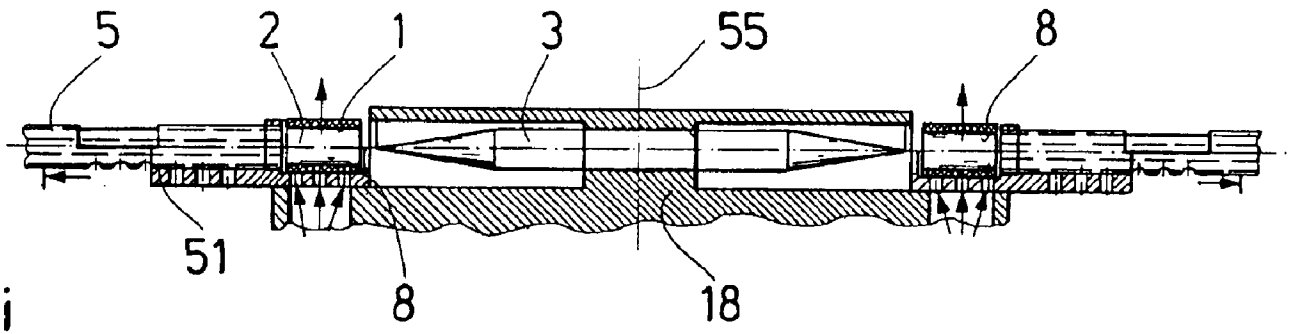

The sleeve 5 is then pulled back so that the produced filter element 8 is removed with the aid of removal drum 43 (FIG. 3) from the receptacle in sled 51. The transfer to the removal drum 43 is aided by supplying excess pressure to the bores 52 of sled 51. (FIG. 4*i*).

For the embodiment shown in FIGS. 4*a* to 4*i*, the troughs in the sled 51 are moved axially during their rotational movement on the operating drum 18 (FIG. 3) with the aid of a cam ring. For this, the mandrels 3 are designed to remain fixed in one position relative to the moving first filter segment 1.

In contrast to the exemplary embodiment shown in FIGS. 2*a* to 2*h*, the first filter segment 1 of the exemplary embodiment according to FIGS. 4*a* to 4*i* is moved in longitudinal axial direction, whereas the mandrel 3 for the first embodiment is moved back and forth.

According to a preferred embodiment, several troughs are provided for holding first and second filter segments on sled sections.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for producing multi-segment filter elements in the tobacco-processing industry, wherein the multi-segment filter elements each include a first filter segment and at least one second filter segment, the method comprising:

arranging a sleeve element in the first filter segment;

inserting the second filter segment into the sleeve element in the first filter segment; and pulling the sleeve element out.

2. The method according to claim 1, further including compacting the material of the first filter segment prior to arranging the sleeve element.

3. The method according to claim 2, wherein the compacting step includes compacting the material of the first filter segment with a mandrel element.

4. The method according to claim 3, wherein the compacting step includes admitting the mandrel element with ultrasound.

5. The method according to claim 3, including using a mandrel element with a low-friction surface.

6. The method according to claim 5, wherein the using step includes using a mandrel coated with one of ceramic and electroplated chromium.

7. The method according to claim 3, wherein the compacting step includes piercing the first filter segment with the mandrel element which comes into with the sleeve element.

8. The method according to claim 7, wherein the piercing step includes piercing the first filter segment with a rotating movement.

9. The method according to claim 7, further including inserting the sleeve element into the filter segment while making contact with the mandrel element.

10. The method according to claim 1, further including arranging the second filter segment inside the sleeve element.

11. The method according to claim 1, further including securing the first filter segment in place before the material of the first filter segment is compacted.

12. The method according to claim 11, further including pulling out the sleeve element from the first filter segment and then releasing the first filter segment.

13. The method according to claim 12, further including transferring the respective filter elements to a conveying mechanism following the step of pulling out the sleeve element.

14. The method according to claim 13, wherein the conveying mechanism is a conveying drum.

15. The method according to claim 12, further including performing the foregoing steps on a conveying drum.

16. A multi-segment filter element produced by the method according to claim 1.

17. A method for producing multi-segment filter elements in the tobacco-processing industry, wherein the multi-segment filter elements each include a first filter segment and at least one second filter segment, the method comprising:

arranging a sleeve element in the first filter segment;

inserting the second filter segment into the sleeve element in the first filter segment; and pulling the sleeve element out of the first filter segment.

* * * * *